United States Patent [19]

Wasson

[11] 4,394,782

[45] Jul. 26, 1983

[54] MULTI PURPOSE HEAD SWEATBAND

[76] Inventor: John J. Wasson, P.O. Box 5667, 6329 Masonic Dr., Alexandria, La. 71301

[21] Appl. No.: 237,205

[22] Filed: Feb. 23, 1981

[51] Int. Cl.[3] ..... A42B 5/00

[52] U.S. Cl. ..... 2/181; 2/181.4; 2/182.1

[58] Field of Search ..... 2/181, 181.4, DIG. 11, 2/197, 182.1

[56] References Cited

U.S. PATENT DOCUMENTS

| | | | |
|---|---|---|---|
| 1,434,854 | 6/1922 | Stall . | |
| 1,471,724 | 5/1927 | Ensten . | |
| 1,633,586 | 12/1928 | Hunter . | |
| 2,070,216 | 2/1937 | Rosenberg . | |
| 2,878,479 | 3/1959 | Schuessler . | |
| 2,994,090 | 8/1961 | Ostwald | 2/197 |
| 3,184,758 | 5/1965 | Hirsch . | |
| 3,340,542 | 9/1967 | Greenwald . | |
| 4,011,600 | 3/1977 | Malk . | |

FOREIGN PATENT DOCUMENTS

| | | | |
|---|---|---|---|
| 2390116 | 1/1979 | France | 2/DIG. 11 |

*Primary Examiner*—Doris L. Troutman

*Attorney, Agent, or Firm*—Fulbright & Jaworski

[57] ABSTRACT

A head sweatband. The band has a cloth member for wrapping around a person's head. The cloth member has a peak at the top, two flaps at the bottom, and an end fastener to insure a comfortable fit as desired. Stitching on the cloth member reinforces it and facilitates its folding. A slight indentation in the bottom of the cloth member prevents vision impairment.

7 Claims, 3 Drawing Figures

MULTI PURPOSE HEAD SWEATBAND

BACKGROUND OF THE INVENTION

1. Field of the Invention

This invention relates to the field of headbands and sweatbands, and, more particularly, to the field of headbands and sweatbands for use by those who work, exercise, or engage in athletics.

2. Description of the Prior Art

The prior art discloses a number of headbands and headwear. These items are generally directed to absorbing sweat or maintaining the warmth of a person's ears. None of the prior art devices alone or in combination teaches or suggest a unitary device that absorbs sweat, maintains ear warmth, and deflects oncoming air or wind over the head. Nor does any of the prior art devices, taken alone or in combination with others, teach or suggest a headband which can be used in both hot and cold weather.

SUMMARY OF THE INVENTION

The present invention is directed to a head sweatband having a cloth member for wrapping around a person's head. The cloth member has a peak at its top, two flaps at its bottom, and fastening means at either of its ends. The peak is sufficiently large enough to act as a deflector or spoiler. The band has lines of stitching across which reinforce it and permit it to be folded easily. In the unfolded position, the band flaps cover the ears. In warmer weather the band is folded so that the ear flap portions no longer cover the ears. The band leaves the top of the wearer's head uncovered so that body heat can be released efficiently from the top of the head. The cloth used can, as desired, be natural or synthetic and can be a very absorbent material such as toweling or terry cloth. An indentation is provided at the bottom of the cloth member to insure that the vision of the wearer is not impaired, even when the headband is worn over the ears. A releasably cooperating fastener such as VELCRO ("Trademark") can be utilized to provided efficient means for holding the band on the wearer's head.

It is, therefore, an object of the present invention to provide an efficient, comfortable, adjustable band for use by workers, exercisers, and athletes.

A further object of the present invention is the provision of a band that can be used to warm the wearer's ears and the sides of the wearer's head in cold weather and yet which can be folded so that it is wearable above the ears in warmer weather.

Another object of the present invention is the provision of a band having a frontal peak which deflects oncoming air or wind when the band is worn by a runner, bicycle rider, or the like.

Yet another object of the present invention is the provision of a band having a releasably cooperating fastener which can be affixed to the band to provide sure, adjustable, but quick-release, fastening even during strenuous movement.

Still another object of the present invention is the provision of a band which does not impair the wearer's vision.

A still further object of the present invention is the provision of a band made from absorbent material to absorb the sweat of the wearer.

A particular object of the present invention is the provision of a band made up of a plurality of layers of material.

Another particular object of the present invention is the provisions of a band that will hold the wearer's hair in place.

Other and further objects, features, and advantages of this multi-purpose head sweatband will be apparent from the following description of the presently preferred embodiment of the invention, given for the purpose of disclosure and taken in conjunction with the accompanying drawings.

DESCRIPTION OF THE DRAWINGS

In the drawings forming a part of the disclosure herein.

DESCRIPTION OF THE PREFERRED EMBODIMENT

Figure 1:
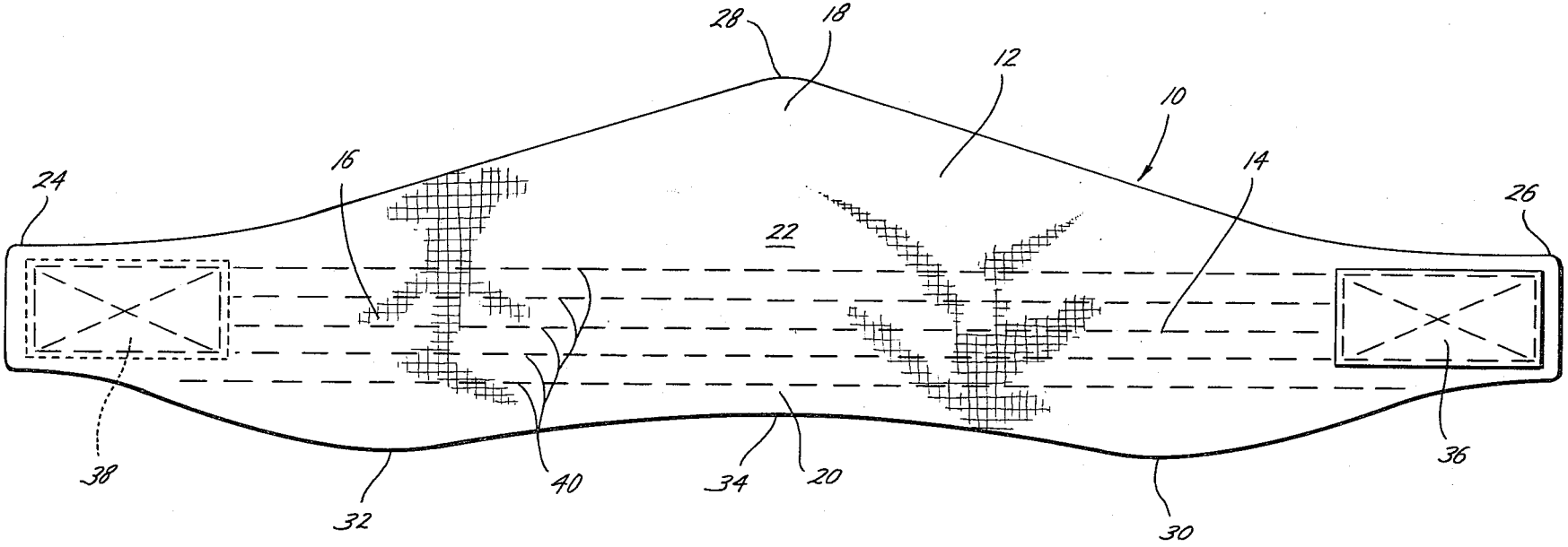
FIG. 1 is a view of one side of the head sweatband according to the present invention.

Referring now to the drawings, the band 10 has the cloth member 12 which includes the right side 14, the left side 16, the top 18, the bottom 20, the mid-portion 22, the left end portion 24, and the right end portion 26. The peak 28 is formed integrally of the top 18. The two flaps, the right flap 30 and the left flap 32, are formed integrally of the right side 14 and the left side 16, respectively. The indentation 34 is formed in the bottom 20 between the two flaps 30 and 32.

Although any conventional and well-known fastening means such as button and buttonhole or hook and eyelet can be used, it has been found that a releasably cooperating fastener, for example VELCRO ("Trademark"), is the preferred means for securing the headband according to the present invention around the wearer's head. The releasably cooperating fastener as shown in FIG. 1 has two parts, the right part 36 and the left part 38 (shown in FIG. 3). By using relatively elongated pieces of releasably cooperating fastener, adjustment is provided in the tightness or looseness with which the headband can be secured to the wearer's head.

Figure 3:
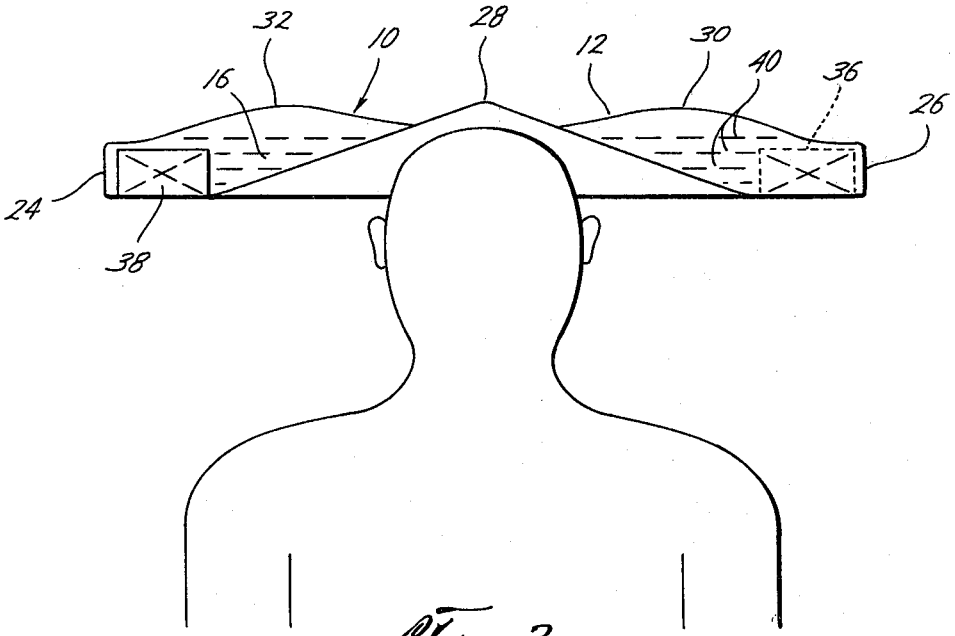
FIG. 3 is a view of the other side of the head sweatband of FIG. 1 after it has been folded and is about to be wrapped around a person's head.

The lines of stitching 40 extend from the right end portion 26 to the left end portion 24. These lines of stitching serve to reinforce the headband and to hold it together, especially in an embodiment employing more than one layer of material. Also, these lines of stitching make it easy to fold the band 10. As shown in FIG. 3 when it is desired to wear the flaps 30 and 32 up rather than down over the ears, the band 10 can be folded so that it is wearable comfortably above the ears. Again in this folded position the peak 28 can extend above the wearer's head to deflect oncoming air or wind.

Figure 2:
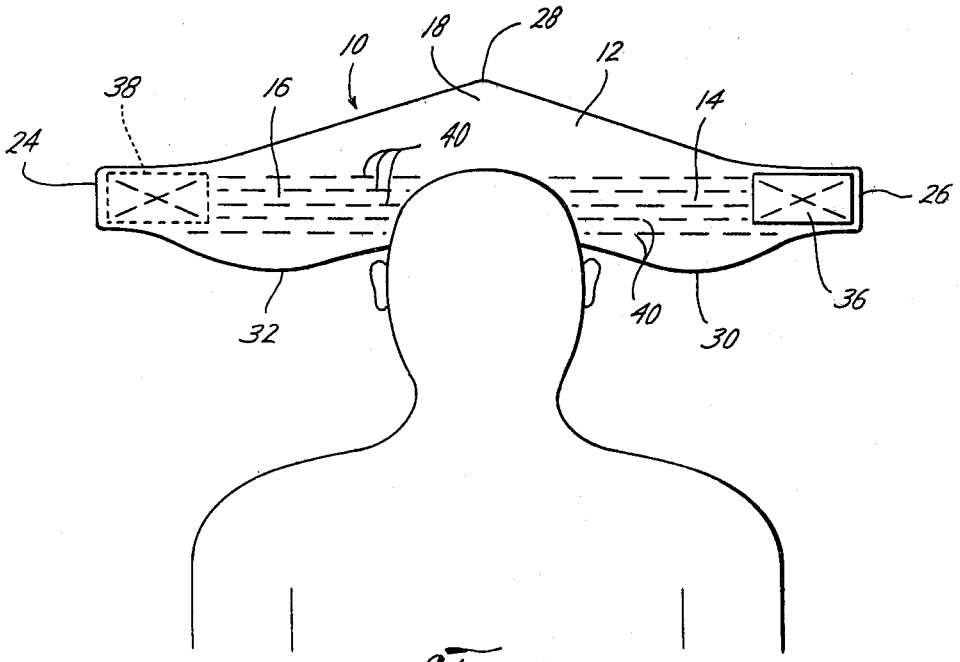
FIG. 2 is a view of the head sweatband of FIG. 1 showing it about to be wrapped around a person's head.

In the unfolded mode as shown in FIGS. 1 and 2, the band 10 can be worn at any desired angle with respect to the ears so as to cover all or part of the ears while at the same time not impairing the wearer's vision due to the indentation 34 in the cloth member 12. In either the folded or unfolded mode, the band 10 provides at least one layer of material extending completely around the wearer's head. This makes it possible to hold all of the wearer's hair and to catch sweat all around the wearer's head.

Although the cloth member 12 can be any material, in the preferred embodiment it is made of a very absorbent material such as terry cloth. It is also within the scope of this invention to use layers made of different material; for example, an interior layer of cotton flannel and an exterior layer of terry cloth.

The present invention, therefore, is well adapted to carry out the objects and attain the ends and advantages mentioned as well as others inherent therein. While a presently preferred embodiment of the invention has been given for the purpose of disclosure, numerous changes in the details of construction, the combination, shape, size and arrangement of parts may be resorted to without departing from the spirit and scope of the invention.

I claim:

1. A head sweatband for a person to wear comprising a cloth member for wrapping around the person's head, the cloth member having two sides, a top, a bottom, a mid-portion and two end portions, a front surface and a rear surface and a peak formed integrally of the top of the cloth member and two flaps, one formed integrally of each of the side portions of the cloth member at the bottom thereof, and securing means connected to the cloth member for securing the head sweatband on the wearer's head.

2. The head sweatband of claim 1 wherein the securing means comprises a two-part releasably cooperating fastener with one part of the fastener on each of the two end portions of the cloth member, one part on the front surface of the cloth member and the other part on the rear surface of the cloth member.

3. The head sweatband of claim 1 wherein the cloth member is made of an absorbent material.

4. The head sweatband of claim 1 wherein the cloth member comprises a plurality of layers of cloth.

5. The head sweatband of claim 1 wherein the cloth member has a plurality of lines of stitches extending from one side to the other for reinforcing the head sweatband and for facilitating the folding thereof.

6. The head sweatband of claim 1 wherein the cloth member has an indentation formed integrally thereof at the bottom between the two flaps to prevent the impairment of the wearer's vision.

7. A head sweatband for a person to wear comprising a cloth member for wrapping around the wearer's head, the cloth member having two sides, a top, a bottom, a mid-portion, a front surface, a rear surface, and two end portions, and a peak formed integrally of the top, two flaps, one formed integrally of each of the side portions at the bottom, and an indentation at the bottom between the flaps to prevent the vision impairment of the person wearing the head sweatband, the cloth member comprising a plurality of layers of an absorbent material, the cloth member having a plurality of lines of stitching across it for reinforcing the head sweatband and for facilitating the folding thereof, and securing means connected to the cloth member for securing the head sweatband on the wearer's head, the securing means comprising a two-part releasably cooperating fastener with one part of the fastener on each of the two end portions of the cloth member, one part on the front surface of the cloth member and the other part on the rear surface of the cloth member.

* * * * *